US009976556B2

(12) United States Patent
Nagaoka et al.

(10) Patent No.: US 9,976,556 B2
(45) Date of Patent: May 22, 2018

(54) SCROLL COMPRESSOR

(71) Applicant: Mitsubishi Electric Corporation, Tokyo (JP)

(72) Inventors: Fumikazu Nagaoka, Tokyo (JP); Teruhiko Nishiki, Tokyo (JP); Hiroyasu Takahashi, Tokyo (JP); Keisuke Narumi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 293 days.

(21) Appl. No.: 14/443,692

(22) PCT Filed: Oct. 3, 2013

(86) PCT No.: PCT/JP2013/076961
§ 371 (c)(1),
(2) Date: May 19, 2015

(87) PCT Pub. No.: WO2014/083939
PCT Pub. Date: Jun. 5, 2014

(65) Prior Publication Data

US 2015/0285249 A1 Oct. 8, 2015

(30) Foreign Application Priority Data

Nov. 30, 2012 (JP) ..... 2012-262313

(51) Int. Cl.
*F04C 18/02* (2006.01)
*F04C 23/00* (2006.01)
(Continued)

(52) U.S. Cl.
CPC ..... *F04C 18/0215* (2013.01); *F04C 23/008* (2013.01); *F04C 29/026* (2013.01);
(Continued)

(58) Field of Classification Search
CPC F04B 39/0246; F04C 18/0215; F04C 23/008; F04C 29/026; F04C 29/028;
(Continued)

(56) References Cited

U.S. PATENT DOCUMENTS 5,666,015 A * 9/1997 Uchibori ..... H02K 1/276 310/156.53
6,799,362 B2 * 10/2004 Murakami ..... H02K 1/276 29/598
(Continued)

FOREIGN PATENT DOCUMENTS

JP S58-160587 A 9/1983
JP H05-256271 A 10/1993
(Continued)

OTHER PUBLICATIONS

English Translation of JP 2006-125211 obtained Apr. 3, 2017.*
(Continued)

*Primary Examiner* — Devon Kramer
*Assistant Examiner* — Connor Tremarche
(74) *Attorney, Agent, or Firm* — Posz Law Group, PLC

(57) ABSTRACT

A scroll compressor includes a sealed container, a compression mechanism portion for a refrigerant, a compliant frame and a guide frame which support an orbiting scroll, an electric motor which drives the orbiting scroll, balance weights, a refrigerant flow path which introduces a refrigerant gas discharged through a discharge port of a fixed scroll to a bottom portion of the sealed container, cup-shaped members provided on both upper and lower surfaces of the rotor of the electric motor and contain the balance weights, a penetrating flow path through which the refrigerant gas containing a refrigerating machine oil flows from a lower side of the rotor of the electric motor through the interiors of the cup-shaped members to an upper side of the rotor, and
(Continued)

a discharge cover which is provided at a lower portion of the frame, and which introduces the refrigerant gas to a discharge pipe.

6 Claims, 6 Drawing Sheets

(51) Int. Cl.
*F04C 29/00* (2006.01)
*F04C 29/02* (2006.01)

(52) U.S. Cl.
CPC ..... *F04C 29/028* (2013.01); *F04C 29/0085* (2013.01); *F04C 2240/60* (2013.01); *F04C 2240/807* (2013.01)

(58) Field of Classification Search
CPC ..... F04C 29/0085; F04C 2240/60; F04C 2240/807; H02K 1/276
USPC ..... 417/410.5
See application file for complete search history.

(56) References Cited

U.S. PATENT DOCUMENTS 6,946,754 B2 9/2005 Inagaki et al.
7,384,250 B2 * 6/2008 Shin ..... F04C 18/0215 184/6.18
7,393,191 B2 * 7/2008 Morozumi ..... F04C 29/045 418/101
2007/0217936 A1 * 9/2007 Oh ..... F04C 29/026 418/55.6
2010/0150752 A1 * 6/2010 Nakamura ..... F04C 23/008 417/410.5
2015/0354572 A1 * 12/2015 Yokoyama ..... F04B 39/0246 62/469

FOREIGN PATENT DOCUMENTS

JP 2006-105123 A 4/2006
JP 2006-125211 A 5/2006
JP 2006125211 A * 5/2006
JP 2012-202208 A 10/2012
JP 2012-202252 A 10/2012
KR 10-2003-0068477 A 8/2003

OTHER PUBLICATIONS

Office Action dated Mar. 22, 2016 in the corresponding CN application No. 201310607084.0 (with English translation).
Office Action dated Jun. 2, 2015 issued in corresponding JP patent application No. 2012-262313 (and English translation).
Extended European Search Report dated Oct. 13, 2016 in the corresponding EP Patent application No. 13858173.1.
Office Action dated Nov. 25, 2016 in the corresponding KR Patent application No. 10-2015-7013737 (with English translation).
Office Action dated Aug. 31, 2015 in the corresponding CN application No. 201310607084.0 (with English translation).
Office Action dated Oct. 9, 2016 in the corresponding CN Patent application No. 201310607084.0 (and English translation).
International Search Report of the International Searching Authority dated Dec. 17, 2013 for the corresponding international application No. PCT/JP2013/076961 (and English translation).
Office Action dated Jan. 24, 2017 issued in corresponding CN patent application No. 201310607084.0 (and English translation).

* cited by examiner

SCROLL COMPRESSOR

CROSS REFERENCE TO RELATED APPLICATIONS

This application is a U.S. national stage application of International Application No. PCT/JP2013/076961 filed on Oct. 3, 2013, which claims priority to Japanese Patent Application No. 2012-262313 filed on Nov. 30, 2012, the disclosures of which are incorporated herein by reference.

TECHNICAL FIELD

The present invention relates to a scroll compressor, and particularly relates to a device which prevents a refrigerating machine oil from flowing out of a sealed container at start of operation of a scroll compressor and during operation of the scroll compressor.

BACKGROUND ART

A scroll compressor includes a sealed container, a compression mechanism portion which includes a fixed scroll and an orbiting scroll, and an electric motor element which rotationally drives the orbiting scroll of the compression mechanism portion. When a high-pressure refrigerant gas which has been compressed by the compression mechanism portion and discharged through a discharge port of the fixed scroll is discharged out of the sealed container as it is, since a refrigerating machine oil which lubricates a bearing portion of a drive portion is contained in the refrigerant gas, the refrigerating machine oil is taken out of the sealed container with the refrigerant gas. Therefore, the refrigerating machine oil stored at a bottom portion of the sealed container is decreased, seizure or the like of a bearing portion of a main shaft which rotationally drives the orbiting scroll occurs due to oil insufficiency, and thus breakdown or the like of the scroll compressor is caused.

As a scroll compressor which solves such a problem, a scroll compressor has been proposed which includes a device which reduces an amount of a refrigerating machine oil that flows out of a sealed container thereof (e.g., see Patent Literature 1). The scroll compressor includes refrigerant guide means for guiding a high pressure refrigerant gas discharged through a discharge port of a fixed scroll, to a rotor side of an electric motor, and oil separation means formed through the rotor of the electric motor for separating oil contained in the refrigerant gas by a centrifugal force caused by rotation of the rotor simultaneously with cooling the electric motor by the refrigerant gas guided by the refrigerant guide means while the refrigerant gas is caused to flow therethrough.

CITATION LIST

Patent Literature

Patent Literature 1: Japanese Unexamined Patent Application Publication No. 2006-105123

SUMMARY OF INVENTION

Technical Problem

In the oil outflow reduction device disclosed in Patent Literature 1, a gas mixture of the refrigerant gas and the refrigerating machine oil discharged from the compression mechanism portion is guided by the refrigerant guide means to an upper surface side of the rotor of the electric motor and moves down through a penetrating flow path provided at the rotor and upper and lower end rings. The refrigerating machine oil contained in the refrigerant gas is separated by a centrifugal force caused by rotation of the rotor while the gas mixture moves down through the penetrating flow path. However, balance weights are fixed to upper and lower surfaces of the rotor for cancelling out unbalance of force associated with revolution movement of the orbiting scroll. The balance weights rotate like vanes of a fan, thereby agitating the refrigerating machine oil and the refrigerant gas discharged from the lower surface of the rotor. Thus, there is the problem that it is not possible to effectively reduce the amount of the oil taken out and the oil outflow prevention effect is not sufficiently achieved.

The present invention has been made in order to solve the problem as described above, and it is an object of the present invention to obtain a scroll compressor which prevents agitation of a refrigerant gas and a refrigerating machine oil by a balance weight, improves oil separation efficiency, and has high reliability.

Solution to Problem

A scroll compressor according to the present invention includes: a sealed container; a compression mechanism portion provided within the sealed container and having a compression chamber in which plate-like scroll teeth of a fixed scroll and an orbiting scroll are meshed with each other to compress a refrigerant; an electric motor provided within the sealed container and configured to rotationally drive the orbiting scroll; a rotary shaft configured to transfer a drive force of the electric motor to the orbiting scroll; a frame configured to rotatably support the rotary shaft; balance weights fixed to an upper surface and a lower surface of a rotor of the electric motor and configured to cancel out unbalance of a force generated in the compression mechanism portion; a refrigerant flow path configured to introduce a refrigerant gas discharged through a discharge port provided in the fixed scroll of the compression mechanism portion, to a bottom portion of the sealed container; cup-shaped members provided on the upper surface and the lower surface of the rotor of the electric motor and containing the balance weights; a penetrating flow path through which the refrigerant gas containing a refrigerating machine oil flows from a lower side of the rotor of the electric motor through interiors of the cup-shaped members to an upper side of the rotor; and a discharge cover provided at a lower portion of the frame, having an opening opposed to an opening of one of the cup-shaped members respectively provided on the upper surface of the rotor of the electric motor, and configured to introduce the refrigerant gas having passed through the penetrating flow path, to a discharge pipe mounted to the sealed container.

Advantageous Effects of Invention

In the scroll compressor according to the present invention, since the cup-shaped members contain the balance weights and are provided on both upper and lower surfaces of the rotor, the refrigerant gas and the refrigerating machine oil discharged from the compression mechanism portion are allowed to be introduced to the bottom portion of the sealed container without being agitated by the balance weights. While a gas mixture of the refrigerant gas and the refrigerating machine oil moves up through the penetrating flow path provided in the rotor, the refrigerating machine oil is separated from the gas mixture by a centrifugal force caused by rotation of the rotor. The refrigerant gas from which the refrigerating machine oil has been separated flows from the interior of the cup-shaped member on the upper surface of the rotor through the interior of the discharge cover and is discharged through the discharge pipe to the outside of the sealed container. In addition, since the discharge cover is provided at the lower portion of the frame and separated from a space filled with the gas mixture of the refrigerant gas and the refrigerating machine oil discharged from the compression mechanism portion, the refrigerant gas from which the refrigerating machine oil has been separated is allowed to be introduced to the outside of the sealed container without being mixed with the refrigerating machine oil again. Therefore, according to the present invention, an effect is obtained that agitation of the refrigerant gas and the refrigerating machine oil by the balance weights is prevented, the oil separation efficiency is improved, and a scroll compressor having high reliability is obtained.

DESCRIPTION OF EMBODIMENTS

Hereinafter, Embodiments of a scroll compressor according to the present invention will be described with reference to the drawings. The scroll compressor described here is shown as an example of a vertical type, but the present invention is applicable to a horizontal type. In addition, the drawings described below including FIG. 1 are schematically shown, and a relationship in size between each component is sometimes different from actual one.

Embodiment 1

Figure 1:
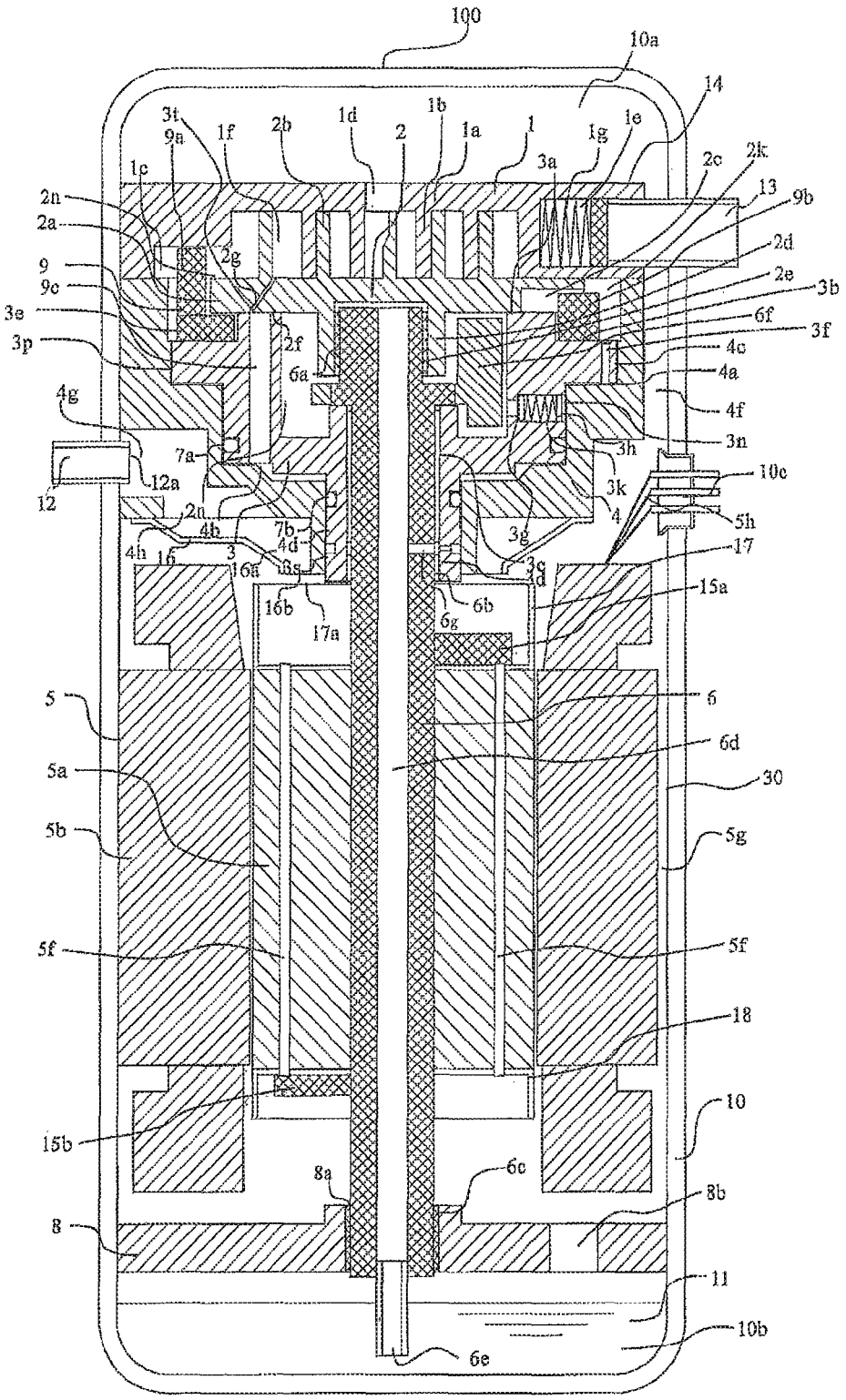
FIG. 1 is a longitudinal cross-sectional view showing a scroll compressor according to Embodiment 1 of the present invention.

FIG. 1 is a longitudinal cross-sectional view of a scroll compressor 100 according to Embodiment 1 of the present invention. With reference to FIG. 1, the configuration and operation of the scroll compressor 100 which is a vertical type will be described.

The scroll compressor 100 is one of components of a refrigeration cycle used in various industrial machines such as a refrigerator, a freezer, an air-conditioning apparatus, a refrigerating apparatus, and a water heater.

The scroll compressor 100 sucks a refrigerant circulating through the refrigeration cycle, compresses the refrigerant into a high-temperature and high-pressure state, and discharges the refrigerant. The scroll compressor 100 includes, within a sealed container 10, a compression mechanism portion 14 which is a combination of a fixed scroll 1 and an orbiting scroll 2 which revolves (swings) relative to the fixed scroll 1. In addition, the scroll compressor 100 includes, within the sealed container 10, an electric motor 5 which connects the orbiting scroll 2 to a main shaft 6 and drives the orbiting scroll 2. In the case of the vertical type scroll compressor 100, within the sealed container 10, for example, the compression mechanism portion is disposed at the upper side, and the electric motor 5 is disposed at the lower side.

The fixed scroll 1 includes a base plate portion 1*a* and a plate-like scroll tooth 1*b* which is a scroll lap provided on one surface (the lower side in FIG. 1) of the base plate portion 1*a*. In addition, the orbiting scroll 2 includes a base plate portion 2*a* and a plate-like scroll tooth 2*b* which is a scroll lap which is provided on one surface (the upper side in FIG. 1) of the base plate portion 2*a* and has substantially the same shape as the plate-like scroll tooth 1*b*. The plate-like scroll tooth 1*b* of the fixed scroll 1 and the plate-like scroll tooth 2*b* of the orbiting scroll 2 mesh with each other, thereby forming a compression chamber 1*f* whose volume relatively changes.

The fixed scroll 1 is fastened at an outer peripheral portion thereof to a guide frame 4 by means of bolts (not shown). A suction pipe 13 for introducing a refrigerant gas from a suction port 1*e* through a suction check valve 1*g* to the compression chamber 1*f* is provided at an outer peripheral portion of the base plate portion 1*a* of the fixed scroll 1. A center portion of the base plate portion 1*a* of the fixed scroll 1 has a discharge port 1*d* through which the refrigerant gas compressed into a high pressure gas is discharged. The refrigerant gas compressed into a high pressure gas is discharged to an upper space 10*a* within the sealed container 10. As described later, the refrigerant gas discharged to the upper space 10*a* is introduced through a refrigerant flow path to an oil separation mechanism, and the refrigerant gas from which oil has been separated is discharged through a discharge pipe 12, whereby the refrigeration cycle is formed.

The orbiting scroll 2 is configured to revolve (swing) relative to the fixed scroll 1 without rotating relative to the fixed scroll 1, by an Oldham mechanism 9 for preventing rotation. The outer peripheral portion of the base plate portion 1*a* of the fixed scroll 1 has a pair of Oldham guide grooves 1*c* each formed substantially on a straight line. A pair of fixed-side keys 9*a* of the Oldham mechanism 9 are engaged with the Oldham guide grooves 1*c* so as to be slidable back and forth. In addition, an outer peripheral portion of the base plate portion 2*a* of the orbiting scroll 2 has a pair of Oldham guide grooves 2*c* which have a phase difference of 90 degrees with respect to the Oldham guide grooves 1*c* of the fixed scroll 1 and are each formed substantially on a straight line. A pair of swing-side keys 9*b* of the Oldham mechanism 9 are engaged with the Oldham guide grooves 2*c* so as to be slidable back and forth.

The orbiting scroll 2 is able to swing (revolve) without rotating, by the Oldham mechanism 9 configured as described above. In addition, a boss portion 2*d* having a hollow cylindrical shape is formed at a center of a surface (at the lower side in FIG. 1) of the orbiting scroll 2 which is opposite to the surface on which the plate-like scroll tooth 2*b* is formed. An eccentric shaft portion (swing shaft portion) 6*a* provided at an upper end portion of the main shaft 6 is inserted in the boss portion 2*d*. In addition, a thrust surface 2*f* which is slidable relative to a thrust bearing 3*a* of a compliant frame 3 in a pressure contact therewith is formed in the surface of the base plate portion 2*a* of the orbiting scroll 2 which is opposite to the plate-like scroll tooth 2*b* (at the lower side in FIG. 1). Moreover, a bleeding hole 2*g* is provided in the base plate portion 2*a* of the orbiting scroll 2 so as to extend through the compression chamber 1*f* and the thrust surface 2*f*, thereby providing a structure to extract the refrigerant gas being compressed and introduce the refrigerant gas to the thrust surface 2*f*.

The compliant frame 3 is housed within the guide frame 4. The compliant frame 3 is provided with an upper cylindrical surface 3*p* and a lower cylindrical surface 3*s* on an outer peripheral portion thereof. An inner peripheral portion of the guide frame 4 is provided with an upper cylindrical surface 4*c* and a lower cylindrical surface 4*d* to which the upper cylindrical surface 3*p* and the lower cylindrical surface 3*s* of the compliant frame 3 are fitted, respectively. The compliant frame 3 is radially supported within the guide frame 4 by fitting the upper cylindrical surface 3*p* and the upper cylindrical surface 4*c* to each other and fitting the lower cylindrical surface 3*s* and the lower cylindrical surface 4*d* to each other. In addition, at a center portion of the lower cylindrical surface 3*s* of the compliant frame 3, a main bearing 3*c* and an auxiliary main bearing 3*d* are provided which radially supports the main shaft 6 which is rotationally driven by a rotor 5*a* of the electric motor 5. In addition, a communication hole 3*e* is provided so as to extend in an axial direction from a surface of the thrust bearing 3*a* through the outer peripheral portion of the compliant frame 3. A thrust bearing opening 3*t* opened at an upper end of the communication hole 3*e* is opposed to the bleeding hole 2*g* extending through the base plate portion 2*a* of the orbiting scroll 2.

In addition, a surface (reciprocation slide surface) 3*b* on which an Oldham mechanism annular portion 9*c* is slidable back and forth is formed at an outer peripheral side of the thrust bearing 3*a* of the compliant frame 3, and a communication hole 3*f* which provides communication between a base plate outer peripheral portion space 2*k* and a frame upper space 4*a* is formed so as to communicate with the inner side of the Oldham mechanism annular portion 9*c*. Furthermore, in the compliant frame 3, between the frame upper space 4*a* and a boss portion outer space 2*n*, an intermediate pressure regulating valve space 3*n* is provided for housing an intermediate pressure regulating valve 3*g* which regulate the pressure in the boss portion outer space 2*n*, an intermediate pressure regulating valve holder 3*h*, and an intermediate pressure regulating spring 3*k*. The intermediate pressure regulating spring 3*k* is housed such that the intermediate pressure regulating spring 3*k* is contracted to be shorter than its natural length.

In Embodiment 1, the compliant frame 3 and the guide frame 4 are configured as separate components, but are not limited thereto, and both frames may be configured as a single integrate frame.

A frame lower space 4*b* is defined by the inner surface of the guide frame 4 and the outer surface of the compliant frame 3 and sealed at an upper portion and a lower portion thereof by ring-shaped sealing materials 7*a* and 7*b*. Here, ring-shaped sealing grooves for receiving the ring-shaped sealing materials 7*a* and 7*b* are formed at two locations on the inner peripheral surface of the guide frame 4, but these sealing grooves may be formed on the outer peripheral surface of the compliant frame 3. The frame lower space 4*b* communicates only with the communication hole 3*e* of the compliant frame 3 and is structured to enclose the refrigerant gas which is being compressed and is supplied from the bleeding hole 2*g*. In addition, a space which is at the outer side of the thrust bearing 3*a* and is surrounded at an upper portion and a lower portion thereof by the base plate portion 2*a* of the orbiting scroll 2 and the compliant frame 3, namely, the base plate outer peripheral portion space 2*k*, is a low-pressure space having a suction gas atmosphere (suction pressure).

Figure 2:
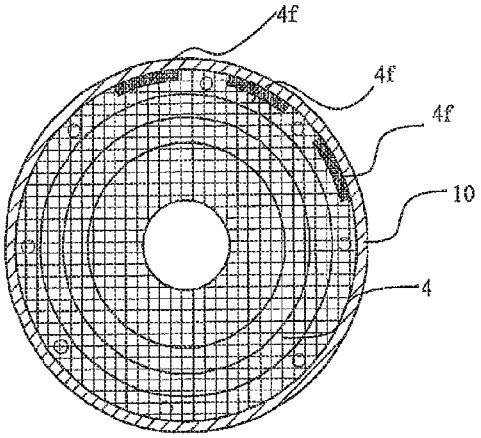
FIG. 2 is a transverse cross-sectional view showing a first path provided at an outer peripheral portion of a guide frame in FIG. 1.

FIG. 2 is a transverse cross-sectional view showing first paths 4*f* provided at the outer peripheral portion of the guide frame 4 in FIG. 1. As shown in FIG. 2, the guide frame 4 is secured at an outer peripheral surface thereof to the sealed container 10 by means of shrinkage fitting, welding, or the like. The first paths 4*f* are provided on the guide frame 4 and the fixed scroll 1, namely, an outer peripheral portion of the compression mechanism portion 14, in the form of cuts. The refrigerant gas discharged through the discharge port 1*d* to the upper space 10*a* of the sealed container 10 flows downward through the first paths 4*f* in the sealed container 10. A bottom portion of the sealed container 10 is an oil reservoir portion 10*b* in which a refrigerating machine oil 11 is stored.

The discharge pipe 12 through which the refrigerant gas is discharged to the outside is provided to the sealed container 10. The first paths 4*f* are provided at a side opposite to the discharge pipe 12. In addition, a first discharge path 4*g* is provided so as to extend from a lower end center of the guide frame 4 to a lateral surface of the guide frame 4 and leads to the discharge pipe 12. Moreover, a discharge cover 16 having an opening 16*b* so as to surround a lower cylindrical portion (a portion on which the lower cylindrical surface 4*d* is formed) is provided at a lower end of the guide frame 4. A second discharge path 16*a* within the discharge cover 16 communicates with the first discharge path 4*g*.

The electric motor 5 rotationally drives the main shaft 6, and includes the rotor 5*a* fixed to the main shaft 6, a stator 5*b* fixed to the sealed container 10, and the main shaft 6 which is a rotary shaft. The rotor 5*a* is fixed to the main shaft 6 by means of shrinkage fitting, and is configured to be rotationally driven by start of energization of the stator 5*b* to rotate the main shaft 6. In addition, the upper end portion of the main shaft 6 has the eccentric shaft portion 6*a* which is rotatably engaged with a swing bearing 2*e* of the orbiting scroll 2, and a main shaft balance weight 6*f* is fixed at a lower side of the eccentric shaft portion 6*a* by means of shrinkage fitting.

Furthermore, a main shaft portion 6*b* which is rotatably engaged with the main bearing 3*c* and the auxiliary main bearing 3*d* of the compliant frame 3 is formed at the lower side of the eccentric shaft portion 6*a*. In addition, a sub-shaft portion 6*c* which is rotatably engaged with a sub-bearing 8*a* of a sub-frame 8 is formed at a lower end portion of the main shaft 6. An inflow hole 8*b* through which the refrigerating machine oil 11 flows into the oil reservoir portion 10*b* is provided in the sub-frame 8. Also, the rotor 5*a* of the electric motor 5 is fixed between the sub-shaft portion 6*c* and the main shaft portion 6*b* by means of shrinkage fitting. An oil supply path 6*d* is provided in the main shaft 6 as a hole extending therethrough in the axial direction, and an oil supply port 6*e* at a lower end of the oil supply path 6*d* is soaked in the refrigerating machine oil 11 stored in the bottom portion of the sealed container 10. Therefore, the refrigerating machine oil 11 is sucked up through the oil supply port 6*e* by an oil supply mechanism or a pump mechanism provided at a lower portion of the main shaft 6. An upper end of the oil supply path 6*d* is opened within the boss portion 2*d* of the orbiting scroll 2, and the sucked-up refrigerating machine oil 11 flows out through the upper end opening of the oil supply path 6*d* to the swing bearing 2*e* to lubricate the eccentric shaft portion 6*a* and the swing bearing 2*e*. In addition, an oil supply hole 6*g* is provided at the oil supply path 6*d* so as to laterally branch therefrom, and the refrigerating machine oil 11 is supplied through the oil supply hole 6*g* to the auxiliary main bearing 3*d* to lubricate the auxiliary main bearing 3*d* and the main shaft portion 6*b*. It should be noted that an oil supply hole to the main bearing 3*c* is omitted in FIG. 1.

A first balance weight 15*a* and a second balance weight 15*b* are fixed to an upper end surface and a lower end surface, respectively, of the rotor 5*a* and at eccentric positions opposed to each other. In addition, in a space outside the boss portion 2*d*, the aforementioned main shaft balance weight 6*f* is fixed to the main shaft 6 and at the lower side of the eccentric shaft portion 6*a*. These three balance weights 15*a*, 15*b*, and 6*f* cancel out unbalance of a force of moment and a centrifugal force caused by the orbiting scroll 2 swinging via the eccentric shaft portion 6*a* of the main shaft 6, whereby static balance and dynamic balance are attained.

Furthermore, a first cup-shaped member 17 which contains the first balance weight 15*a* is fixed to the upper end surface of the rotor 5*a*, and a second cup-shaped member 18 which contains the second balance weight 15*b* is fixed to the lower end surface of the rotor 5*a*. In addition, the first cup-shaped member 17 is provided such that an opening 17*a* at an upper portion thereof is opposed to the opening 16*b* of the aforementioned discharge cover 16. The second cup-shaped member 18 is mounted such that an opening thereof faces downward.

Figure 3:
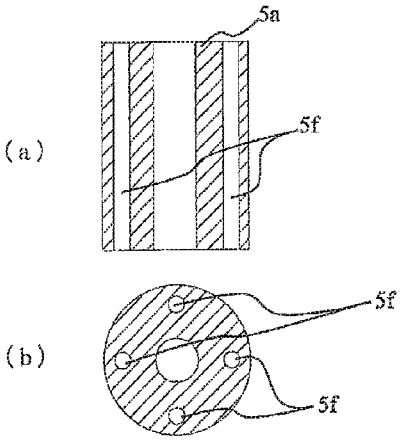
FIG. 3 shows a longitudinal cross-sectional view (a) and a transverse cross-sectional view (b) of a rotor of an electric motor in FIG. 1.

FIG. 3 shows a longitudinal cross-sectional view (a) and a transverse cross-sectional view (b) of the rotor 5*a* of the electric motor 5 in FIG. 1.

As shown in FIGS. 1 and 3, a plurality of penetrating flow paths 5*f* are provided in the rotor 5*a* so as to extend therethrough in the axial direction. In addition, the penetrating flow paths 5*f* are provided so as to avoid the installation positions of the first balance weight 15*a* and the second balance weight 15*b* and extend through bottom portions of the first cup-shaped member 17 and the second cup-shaped member 18 (see FIG. 1). Moreover, the first cup-shaped member 17 and the second cup-shaped member 18 are preferably made of a non-magnetic material. It should be noted that the penetrating flow paths 5*f* may be formed so as to extend through the first balance weight 15*a* and the second balance weight 15*b*, and may be provided so as to avoid the positions of the first cup-shaped member 17 and the second cup-shaped member 18. Furthermore, the plurality of penetrating flow paths 5*f* are formed so as to be symmetrical or point-symmetrical with respect to an axis.

Figure 4:
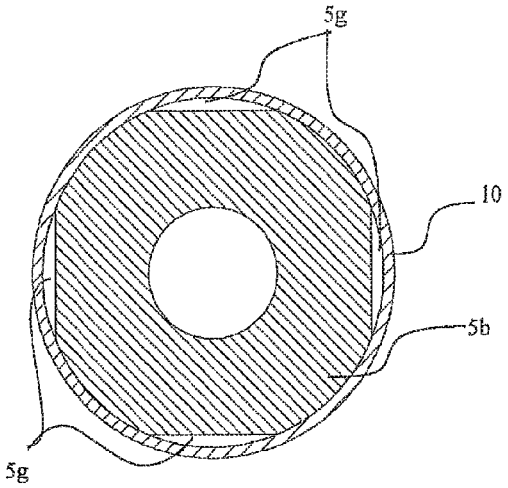
FIG. 4 is a transverse cross-sectional view of a stator of the electric motor in FIG. 1.

FIG. 4 is a transverse cross-sectional view of the stator 5*b* of the electric motor 5 in FIG. 1.

The stator 5*b* of the electric motor 5 is fixed at an outer peripheral surface thereof to the sealed container 10 by means of shrinkage fitting, welding, or the like. As shown in FIG. 4, second paths 5*g* are provided at the outer peripheral portion of the stator 5*b* in the form of cuts.

The aforementioned first paths 4*f* and second paths 5*g* form a refrigerant flow path 30 which introduces the refrigerant gas discharged from the discharge port 1*d*, to the bottom portion of the sealed container 10.

In addition, as shown in FIG. 1, a glass terminal 10*c* is provided at the lateral surface of the sealed container 10, and the glass terminal 10*c* and the stator 5*b* of the electric motor 5 are connected to each other via a lead wire 5*h*.

Next, an operation of the scroll compressor 100 according to Embodiment 1 will be described.

At start of the scroll compressor 100 and during operation of the scroll compressor 100, the refrigerant is sucked through the suction pipe 13 and enters the compression chamber 1*f* which is formed by meshing the plate-like scroll tooth 1*b* of the fixed scroll 1 and the plate-like scroll tooth 2*b* of the orbiting scroll 2. The orbiting scroll 2 driven by the electric motor 5 decreases the volume of the compression chamber 1*f* with an eccentric revolution movement thereof. Because of the compression process, the sucked refrigerant becomes a high-pressure refrigerant. In the compression process, the intermediate-pressure refrigerant gas being compressed is introduced from the bleeding hole 2*g* of the orbiting scroll 2 through the communication hole 3*e* of the compliant frame 3 to the frame lower space 4*b* to maintain an intermediate-pressure atmosphere in the frame lower space 4*b*.

A gas mixture of the refrigerating machine oil and the refrigerant discharged from the discharge port 1*d* of the fixed scroll 1 to the upper space 10*a* of the sealed container 10 through the compression process is introduced through the refrigerant flow path 30, which is made of the first paths 4*f* provided at the outer peripheral portion of the compression mechanism portion 14 and the second paths 5*g* provided at the outer peripheral portion of the stator 5*b* of the electric motor 5, to a lower space below the electric motor 5, that is, the bottom portion of the sealed container 10. The gas mixture is separated while being introduced to the bottom portion of the sealed container 10. The refrigerant gas separated from the refrigerating machine oil 11 enters through the opening of the second cup-shaped member 18 mounted on the lower end surface of the rotor 5*a* of the electric motor 5, into the second cup-shaped member 18, and flows into the penetrating flow paths 5*f* provided in the rotor 5*a*. The refrigerant gas from which the refrigerating machine oil 11 has been separated moves up in the interior of the first cup-shaped member 17 mounted on the upper end surface of the rotor 5*a* and flows into the discharge cover 16. Furthermore, the refrigerant gas from which the refrigerating machine oil 11 has been separated flows through the first discharge path 4*g* via the second discharge path 16*a* within the discharge cover 16 and is discharged through the discharge pipe 12 to the outside of the sealed container 10.

In Embodiment 1, since the first cup-shaped member 17 is provided to contain the first balance weight 15*a* and the second cup-shaped member 18 is provided to contain the second balance weight 15*b*, the penetrating flow paths 5*f* are able to prevent the refrigerant gas, from which the refrigerating machine oil 11 has been separated, from being agitated by rotation of the first balance weight 15*a* and the second balance weight 15*b*. Furthermore, since the opening 17*a* of the first cup-shaped member 17 is opposed to the opening 16*b* of the discharge cover 16 and the discharge cover 16 is separated from the space between the guide frame 4 and the electric motor 5, the refrigerant gas from which the refrigerating machine oil 11 has been separated is not mixed with the gas mixture (the refrigerant gas containing the refrigerating machine oil 11) within the sealed container 10 again. Therefore, it is possible to prevent the refrigerating machine oil 11 from being taken out of the sealed container 10, and thus it is possible to prevent a decrease in reliability of the scroll compressor 100 which is caused by insufficient oil supply.

Embodiment 2

Figure 5:
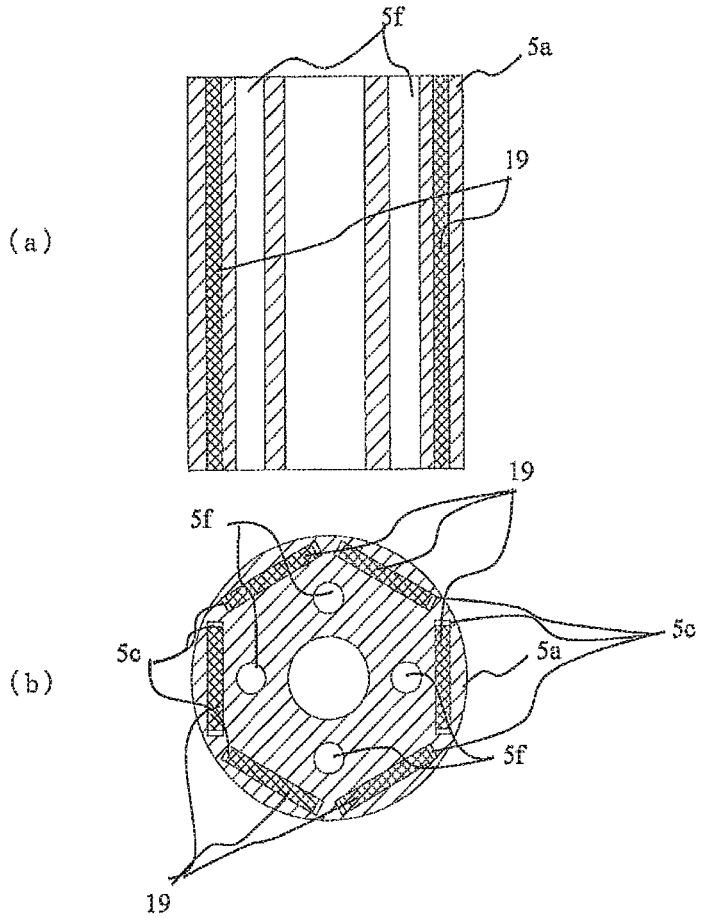
FIG. 5 shows a longitudinal cross-sectional view (a) and a transverse cross-sectional view (b) showing a rotor of an electric motor according to Embodiment 2 of the present invention.

FIG. 5 shows a longitudinal cross-sectional view (a) and a transverse cross-sectional view (b) showing the rotor 5*a* of the electric motor 5 according to Embodiment 2 of the present invention.

In Embodiment 2, except for the rotor 5*a*, the scroll compressor 100 has a configuration as shown in FIG. 1. In addition, the first cup-shaped member 17 and the second cup-shaped member 18 are made of a non-magnetic material.

As shown in FIG. 5, the rotor 5*a* of Embodiment 2 is provided with a plurality of magnet insertion holes 5*c* in the axial direction in addition to the penetrating flow paths 5*f*, and a permanent magnet 19 is inserted and housed in each magnet insertion hole 5*c*. In addition, the operation and effect of oil separation in Embodiment 2 are the same as in Embodiment 1.

In Embodiment 2, the first balance weight 15*a* is fixed to the upper end surface of the rotor 5*a* of the electric motor 5, the second balance weight 15*b* is fixed to the lower end surface of the rotor 5*a*, the first cup-shaped member 17 made of a non-magnetic material is provided on the upper end surface of the rotor 5*a* of the electric motor 5, and the second cup-shaped member 18 made of a non-magnetic material is provided on the lower end surface of the rotor 5*a*. Furthermore, the rotor 5*a* is provided with a plurality of permanent magnets 19 inserted therein, in addition to the penetrating flow paths 5*f*. In addition, although not shown, the first cup-shaped member 17 and the second cup-shaped member 18 are preferably formed in a regular hexagonal outer shape so as to match the arrangement and the shape of the permanent magnets 19 shown in FIG. 5. It should be noted that the permanent magnets 19 may be arranged in a regular polygon such as a square. Since the first cup-shaped member 17 and the second cup-shaped member 18 are formed in such an outer shape, it is possible to prevent the permanent magnets 19 from projecting from the interior of the rotor 5*a*. In addition, not the entirety of the rotor core end surface is covered, and part of the end surface is exposed. Thus, it is possible to perform assembling on the basis of the core end surface and it is possible to manufacture a rotor having less distortion or the like and high accuracy.

As described above, in Embodiment 2, since the first cup-shaped member 17 and the second cup-shaped member 18 are made of a non-magnetic material, it is possible to prevent a magnetic flux of each permanent magnet 19 from leaking to the upper end surface and the lower end surface of the rotor 5*a* of the electric motor 5, and it is possible to prevent the performance of the scroll compressor 100 from being diminished.

Embodiment 3

Figure 6:
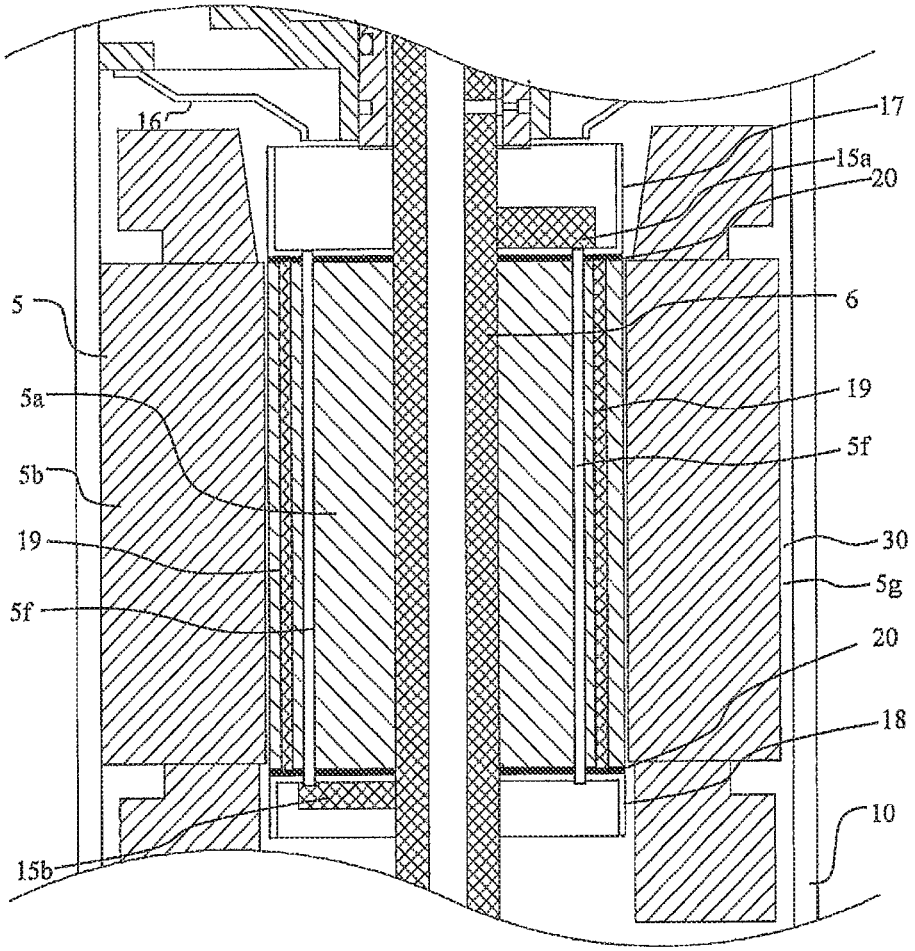
FIG. 6 is a partial cross-sectional view showing elements around a rotor of an electric motor according to Embodiment 3 of the present invention.

FIG. 6 is a partial cross-sectional view showing elements around the rotor 5*a* of the electric motor 5 according to Embodiment 3 of the present invention.

In Embodiment 3, the rotor 5*a* of the electric motor 5 includes permanent magnets 19 inserted in the axial direction and arranged in a regular polygon, a first cup-shaped member 17 and a second cup-shaped member 18 fixed to both end surfaces and made of a magnetic material, and a plate 20 disposed between each of the cup-shaped members 17 and 18 and the rotor 5*a* and made of a non-magnetic material. That is, in the rotor 5*a* of Embodiment 2, the permanent magnets 19 are inserted and arranged in a shape as shown in FIG. 5 of Embodiment 2, the first cup-shaped member 17 and the second cup-shaped member 18 are made of a magnetic material, and the plate 20 made of a non-magnetic material is provided between each of the cup-shaped members 17 and 18 and the rotor 5*a*. The other configuration of the scroll compressor 100 is the same as in Embodiment 1. In addition, the operation and effect of oil separation in Embodiment 3 are the same as in Embodiment 1.

As described above, in Embodiment 3, since the plate 20 made of a non-magnetic material is provided between each of the first cup-shaped member 17 and the second cup-shaped member 18 made of a magnetic material and the end surface of the rotor 5*a* of the electric motor 5, it is possible to prevent the magnetic flux of each permanent magnet 19 from leaking to the upper end surface and the lower end surface of the rotor 5*a* of the electric motor 5 and it is possible to prevent the performance of the scroll compressor 100 from being diminished.

Embodiment 4

Figure 7:
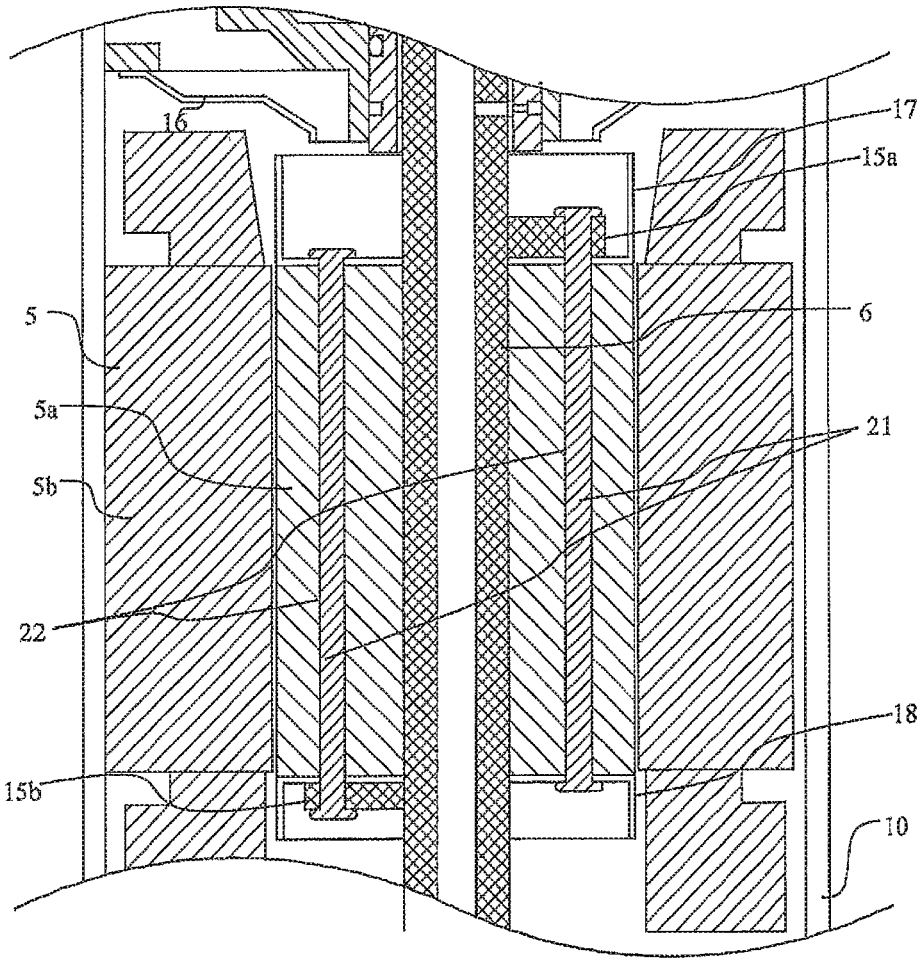
FIG. 7 is a partial cross-sectional view showing elements around a rotor of an electric motor according to Embodiment 4 of the present invention.

FIG. 7 is a partial cross-sectional view showing elements around the rotor 5*a* of the electric motor 5 according to Embodiment 4 of the present invention.

Embodiment 4 is characterized in that, in the scroll compressor 100 of Embodiment 2, the first cup-shaped member 17, the second cup-shaped member 18, the first balance weight 15*a*, the second balance weight 15*b*, and the rotor 5*a* of the electric motor 5 are fixed by rivets 21. The other configuration is the same as in Embodiment 2. In FIG. 7, for simplification of the drawing, the aforementioned penetrating flow paths 5*f* and permanent magnets 19 are omitted. In addition, the operation and effect of oil separation in Embodiment 4 are the same as in Embodiment 1.

As shown in FIG. 7, in a state where the first cup-shaped member 17, the second cup-shaped member 18, the first balance weight 15*a*, the second balance weight 15*b*, and the rotor 5*a* of the electric motor 5 are fitted to each other, rivet insertion holes 22 are provided in these components and extend from the first balance weight 15*a* to the second balance weight 15*b*. The first cup-shaped member 17, the second cup-shaped member 18, the first balance weight 15*a*, the second balance weight 15*b*, and the rotor 5*a* of the electric motor 5 are fixed by a single rivet 21 at each rivet insertion hole.

As described above, in Embodiment 4, since the first cup-shaped member 17, the second cup-shaped member 18, the first balance weight 15*a*, the second balance weight 15*b*, and the rotor 5*a* of the electric motor 5 are fixed by a single rivet 21 at each rivet insertion hole, it is possible to reduce the number of components and it is possible to reduce the manufacturing cost of the scroll compressor 100.

Embodiment 5

Figure 8:
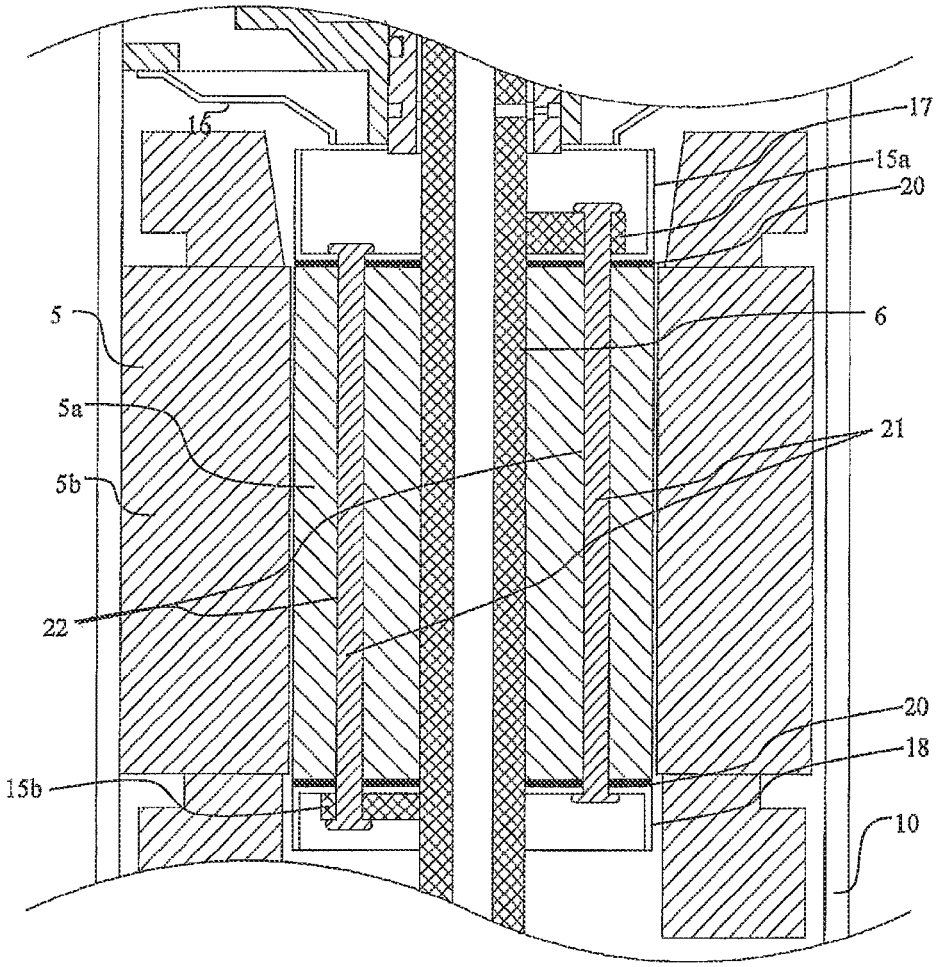
FIG. 8 is a partial cross-sectional view showing elements around a rotor of an electric motor according to Embodiment 5 of the present invention.

FIG. 8 is a partial cross-sectional view showing elements around the rotor 5*a* of the electric motor 5 according to Embodiment 5 of the present invention.

Embodiment 5 is characterized in that, in the scroll compressor 100 of Embodiment 3, the first cup-shaped member 17, the second cup-shaped member 18, the first balance weight 15*a*, the second balance weight 15*b*, the plates 20, the rotor 5*a* of the electric motor 5 are fixed by rivets 21. The other configuration is the same as in Embodiment 3. In FIG. 8, for simplification of the drawing, the aforementioned penetrating flow paths 5*f* and permanent magnets 19 are omitted. In addition, the operation and effect of oil separation in Embodiment 5 are the same as in Embodiment 1.

As shown in FIG. 8, in a state where the first cup-shaped member 17, the second cup-shaped member 18, the first balance weight 15*a*, the second balance weight 15*b*, the plates 20, and the rotor 5*a* of the electric motor 5 are fitted to each other, rivet insertion holes 22 are provided in these components and extend from the first balance weight 15*a* to the second balance weight 15*b*. The first cup-shaped member 17, the second cup-shaped member 18, the first balance weight 15*a*, the second balance weight 15*b*, the plates 20, and the rotor 5*a* of the electric motor 5 are fixed by a single rivet 21 at each rivet insertion hole.

As described above, in Embodiment 5, since the first cup-shaped member 17, the second cup-shaped member 18, the first balance weight 15*a*, the second balance weight 15*b*, the plates 20, and the rotor 5*a* of the electric motor 5 are fixed by a single rivet 21 at each rivet insertion hole, it is possible to reduce the number of components and it is possible to reduce the manufacturing cost of the compressor.

Next, specification of the axial dimensions (heights) of the first cup-shaped member 17, the second cup-shaped member 18, the first balance weight 15*a*, and the second balance weight 15*b* in the scroll compressor 100 according to any of Embodiments 1 to 5 will be described. The other configuration and operation are the same as in Embodiments 1 to 5, and the description thereof is omitted.

The first cup-shaped member 17 is formed such that the axial dimension thereof is larger than or equal to that of the first balance weight 15*a*, and the second cup-shaped member 18 is formed such that the axial dimension thereof is larger than or equal to that of the second balance weight 15*b*.

As described above, by specifying the axial dimensions of the first cup-shaped member 17 and the second cup-shaped member 18, it is possible to completely surround projections and depressions at the first balance weight 15*a* and the second balance weight 15*b* by the first cup-shaped member 17 and the second cup-shaped member 18. Thus, the penetrating flow paths 5*f* are able to prevent the refrigerant gas, from which the refrigerating machine oil 11 has been separated, from being agitated.

REFERENCE SIGNS LIST

1 fixed scroll 1*a* base plate portion 1*b* plate-like scroll tooth

1*c* Oldham guide groove 1*d* discharge port 1*e* suction port 1*f* compression chamber 1*g* suction check valve 2 orbiting scroll 2*a* base plate portion 2*b* plate-like scroll tooth

2*c* Oldham guide groove 2*d* boss portion 2*e* swing bearing

2*f* thrust surface 2*g* bleeding hole 2*k* base plate outer peripheral portion space 2*n* boss portion outer space 3 compliant frame

3*a* thrust bearing 3*b* reciprocation slide surface 3*c* main bearing 3*d* auxiliary main bearing 3*e* communication hole 3*f* communication hole 3*g* intermediate pressure regulating valve 3*h* intermediate pressure regulating valve holder 3*k* intermediate pressure regulating spring 3*n* intermediate pressure regulating valve space 3*p* upper cylindrical surface 3*s* lower cylindrical surface 3*t* thrust bearing opening 4 guide frame 4*a* frame upper space 4*b* frame lower space 4*c* upper cylindrical surface 4*d* lower cylindrical surface 4*f* first path 4*g* first discharge path 4*h* opening 5 electric motor 5*a* rotor 5*b* stator 5*c* magnet insertion hole 5*f* penetrating flow path 5*g* second path 5*h* lead wire 6 main shaft 6*a* eccentric shaft portion 6*b* main shaft portion 6*c* sub-shaft portion 6*d* oil supply path 6*e* oil supply port 6*f* main shaft balance weight 6*g* oil supply hole 7*a* ring-shaped sealing material 7*b* ring-shaped sealing material

8 sub-frame 8*a* sub-bearing 8*b* inflow hole 9 Oldham mechanism 9*a* fixed-side key 9*b* swing-side key 9*c* Oldham mechanism annular portion 10 sealed container 10*a* upper space 10*b* oil reservoir portion 10*c* glass terminal 11 refrigerating machine oil 12 discharge pipe 12*a* discharge pipe leading end portion

13 suction pipe 14 compression mechanism portion 15 balance weight 15*a* first balance weight 15*b* second balance weight 16 discharge cover 16*a* second discharge path 16*b* opening 17 first cup-shaped member 17*a* opening 18 second cup-shaped member 19 permanent magnet 20 plate 21 rivet 22 rivet insertion hole 30 refrigerant flow path 100 scroll compressor

The invention claimed is:

1. A scroll compressor comprising:

a sealed container;

a compression mechanism portion provided within the sealed container and having a compression chamber in which plate-like scroll teeth of a fixed scroll and an orbiting scroll are meshed with each other to compress a refrigerant;

an electric motor provided within the sealed container and configured to rotationally drive the orbiting scroll;

a rotary shaft configured to transfer a drive force of the electric motor to the orbiting scroll;

a frame configured to rotatably support the rotary shaft;

balance weights fixed to an upper surface and a lower surface of a rotor of the electric motor and configured to cancel out unbalance of a force generated in the compression mechanism portion;

a refrigerant flow path configured to introduce a refrigerant gas discharged from a discharge port provided to the fixed scroll of the compression mechanism portion, to a bottom portion of the sealed container;

cup-shaped members respectively provided on the upper surface and the lower surface of the rotor of the electric motor and containing the balance weights;

a penetrating flow path through which the refrigerant gas containing a refrigerating machine oil flows from a lower side of the rotor of the electric motor through interiors of the cup-shaped members to an upper side of the rotor, wherein the penetrating flow path includes a refrigerant passage formed in the rotor that extends from the interior of the cup-shaped member provided on the lower surface to the interior of the cup-shaped member provided on the upper surface; and a discharge cover provided at a lower portion of the frame, having an opening opposed to an opening of one of the cup-shaped members provided on the upper surface of the rotor of the electric motor, and configured to introduce the refrigerant gas having passed through the penetrating flow path, to a discharge pipe provided to the sealed container.

2. The scroll compressor of claim 1, wherein the upper surface and the lower surface of the rotor are end surfaces of the rotor, and the cup-shaped members are fixed to both the upper surface and the lower surface and are made of a non-magnetic material.

3. The scroll compressor of claim 1, wherein the upper surface and the lower surface of the rotor are end surfaces of the rotor, and the cup-shaped members are fixed to both the upper surface and the lower surface and are made of a magnetic material, and a plate, which is made of a non-magnetic material, is located between each cup-shaped member and the rotor.

4. The scroll compressor of claim 2, wherein the rotor of the electric motor, the balance weights, and the cup-shaped members are fixed by a rivet.

5. The scroll compressor of claim 3, wherein the rotor of the electric motor, the balance weights, the cup-shaped members, and the plates are fixed by a rivet.

6. The scroll compressor of claim 1, wherein each of the cup-shaped members has an axial dimension larger than or equal to that of each of the balance weights.

* * * * *